US009148921B2

(12) United States Patent
Zhang et al.

(10) Patent No.: US 9,148,921 B2
(45) **Date of Patent: *Sep. 29, 2015**

(54) METHOD AND APPARATUS FOR ALTERING A COLOR OF A MIXTURE OF LIGHT PROVIDED BY MIXING OUTPUTS OF LIGHT FROM MULTIPLE LAMPS

(71) Applicant: Marvell World Trade LTD., St. Michael (BB)

(72) Inventors: Wanfeng Zhang, Palo Alto, CA (US); Jinho Choi, Saratoga, CA (US)

(73) Assignee: Marvell Word Trade Ltd., St. Michael (BB)

( * ) Notice: Subject to any disclaimer, the term of this patent is extended or adjusted under 35 U.S.C. 154(b) by 0 days.

This patent is subject to a terminal disclaimer.

(21) Appl. No.: 14/251,906

(22) Filed: Apr. 14, 2014

(65) Prior Publication Data

US 2014/0217916 A1 Aug. 7, 2014

Related U.S. Application Data

(63) Continuation of application No. 13/687,249, filed on Nov. 28, 2012, now Pat. No. 8,698,423.

(60) Provisional application No. 61/564,234, filed on Nov. 28, 2011.

(51) Int. Cl.
*H05B 37/02* (2006.01)
*H05B 33/08* (2006.01)

(52) U.S. Cl.
CPC ..... *H05B 33/0815* (2013.01); *H05B 33/0818* (2013.01); *H05B 33/0824* (2013.01); *H05B 33/0857* (2013.01); *H05B 37/02* (2013.01)

(58) Field of Classification Search
CPC ..... H05B 37/02; H05B 33/0815; H05B 33/0818; H05B 33/0824; H05B 33/0857
USPC ..... 315/307, 308, 294, 224, 312, 185 R, 315/291, 297, 247; 362/231, 234, 236, 362/249.02, 249.03, 249.05, 249.06; 345/84, 87, 102
See application file for complete search history.

(56) References Cited

U.S. PATENT DOCUMENTS 6,369,525 B1 4/2002 Chang et al.
7,646,029 B2 * 1/2010 Mueller et al. ..... 257/84
7,969,404 B2 6/2011 Lee et al.

(Continued)

OTHER PUBLICATIONS

U.S. Appl. No. 13/548,797, filed Jul. 2012, Zhang.

(Continued)

*Primary Examiner* — Haissa Philogene

(57) ABSTRACT

A system including first and second lamps, one of an inductor or a transformer, first and second switches, and a control module. The first lamp generates a first output of light having a first color. The second lamp generates a second output of light having a second color. The first and second outputs of light are mixed to provide a mixture of light having a third color. The transformer includes first and second coils. The first and second coils supply power respectively to the first and second lamps. The first and second switches are connected respectively to the first and second coils. The control module alters the third color by controlling (i) a state of the first switch to adjust a first amount of current supplied to the first lamp, and (ii) a state of the second switch to adjust a second amount of current supplied to the second lamp.

20 Claims, 4 Drawing Sheets

(56) References Cited

U.S. PATENT DOCUMENTS

| | | | | |
|---|---|---|---|---|
| 8,013,538 | B2 | 9/2011 | Zampini et al. | |
| 8,698,423 | B2 * | 4/2014 | Zhang et al. | 315/307 |
| 2002/0070914 | A1 | 6/2002 | Bruning | |
| 2005/0179393 | A1 | 8/2005 | Murakami | |
| 2007/0152604 | A1 | 7/2007 | Tatsumi | |
| 2007/0182347 | A1 | 8/2007 | Shteynberg | |
| 2008/0116818 | A1 | 5/2008 | Shteynberg | |
| 2013/0154490 | A1 | 6/2013 | Harbers | |

OTHER PUBLICATIONS

U.S. Appl. No. 13/551,118, filed Jul. 2012, Sutardja et al.
U.S. Appl. No. 13/589,937, filed Aug. 2012, Sutardja et al.
PCT International Search Report and Written Opinion; Mar. 5, 2013.

* cited by examiner

METHOD AND APPARATUS FOR ALTERING A COLOR OF A MIXTURE OF LIGHT PROVIDED BY MIXING OUTPUTS OF LIGHT FROM MULTIPLE LAMPS

CROSS-REFERENCE TO RELATED APPLICATIONS

The present disclosure is a continuation of U.S. patent application Ser. No. 13/687,249 (now U.S. Pat. No. 8,698,423), filed Nov. 28, 2012, which claims the benefit of U.S. Provisional Application No. 61/564,234 filed on Nov. 28, 2011. The entire disclosures of the applications referenced above are incorporated herein by reference.

FIELD

The present disclosure relates to solid-state lighting, and more particularly to controlled color mixing.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Light emitting diodes (LEDs) are used for a number of lighting applications. For example only, LEDs are used in task lighting, architectural lighting, manufacturing lighting, signage lighting, and vehicular lighting. In order to generate light having a certain color, the light from multiple LEDs of different colors may be mixed. For example, an LED color mixing system can include a first LED string and a second LED string. Each of the first LED string and the second LED string includes a series of one or more LEDs. The first LED string may be used to generate a first illuminated output having a first color. The second LED string may be used to generate a second illuminated output having a second color. The first illuminated output may be mixed with the second illuminated output to form a third color.

The first LED string and the second LED string may receive power respectively from a first current regulator and a second current regulator. A power source provides power to both of the first and second current regulators. The second current regulator is separate from the first current regulator. The first current regulator controls an amount of current supplied to the first LED string to, for example, adjust an amount of light produced by the first LED string. The second current regulator controls an amount of current supplied to the second LED string to, for example, adjust an amount of light produced by the second LED string. Illuminated outputs of the first and second LED strings are mixed to produce a third illuminated output having the third color. By controlling the amounts of current to the first and second LED strings, the first and second current regulators control the resulting third color provided by mixing the illuminated outputs of the first and second LED strings.

SUMMARY

A system is provided and includes a first solid-state lamp configured to generate a first illuminated output having a first color. A second solid-state lamp is configured to generate a second illuminated output having a second color. The second illuminated output is mixed with the first illuminated output to generate a third illuminated output having a third color. An inductor or a transformer includes a primary coil and a bias coil. A first circuit includes the primary coil and a first switch. The first circuit is configured to supply power to the first solid-state lamp. A second circuit includes the bias coil and a second switch. The second circuit is configured to supply power to the second solid-state lamp. A control module is configured to alter the third color including controlling (i) a state of the first switch to adjust a first current supplied to the first solid-state lamp, and (ii) a state of the second switch to adjust a second current supplied to the second solid-state lamp.

A method is provided and includes generating a first illuminated output having a first color via a first solid-state lamp. A second illuminated output is generated having a second color via a second solid-state lamp. The second illuminated output is mixed with the first illuminated output to generate a third illuminated output having a third color. Power is supplied to the first solid-state lamp via a first circuit. The first circuit includes a first switch and a primary coil of an inductor or a transformer. Power is supplied to the second solid-state lamp via a second circuit. The second circuit comprises a second switch and a bias coil of the inductor or the transformer. The third color is altered including controlling (i) a state of the first switch to adjust a first current supplied to the first solid-state lamp, and (ii) a state of the second switch to adjust a second current supplied to the second solid-state lamp.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF DRAWINGS

The present disclosure will become more fully understood from the detailed description and the accompanying drawings, wherein.

DESCRIPTION

A color mixing system may include a first LED string and a second LED string. Illuminated outputs of the first and second LED strings may be mixed to provide a resulting illuminated output with a predetermined and/or selected color. Implementations are disclosed herein that include buck-boost and flyback topologies for controlling power and/or current supplied to each of multiple LED strings. The implementations include use of a single stage converter and provide accurate current control techniques.

Figure 1:
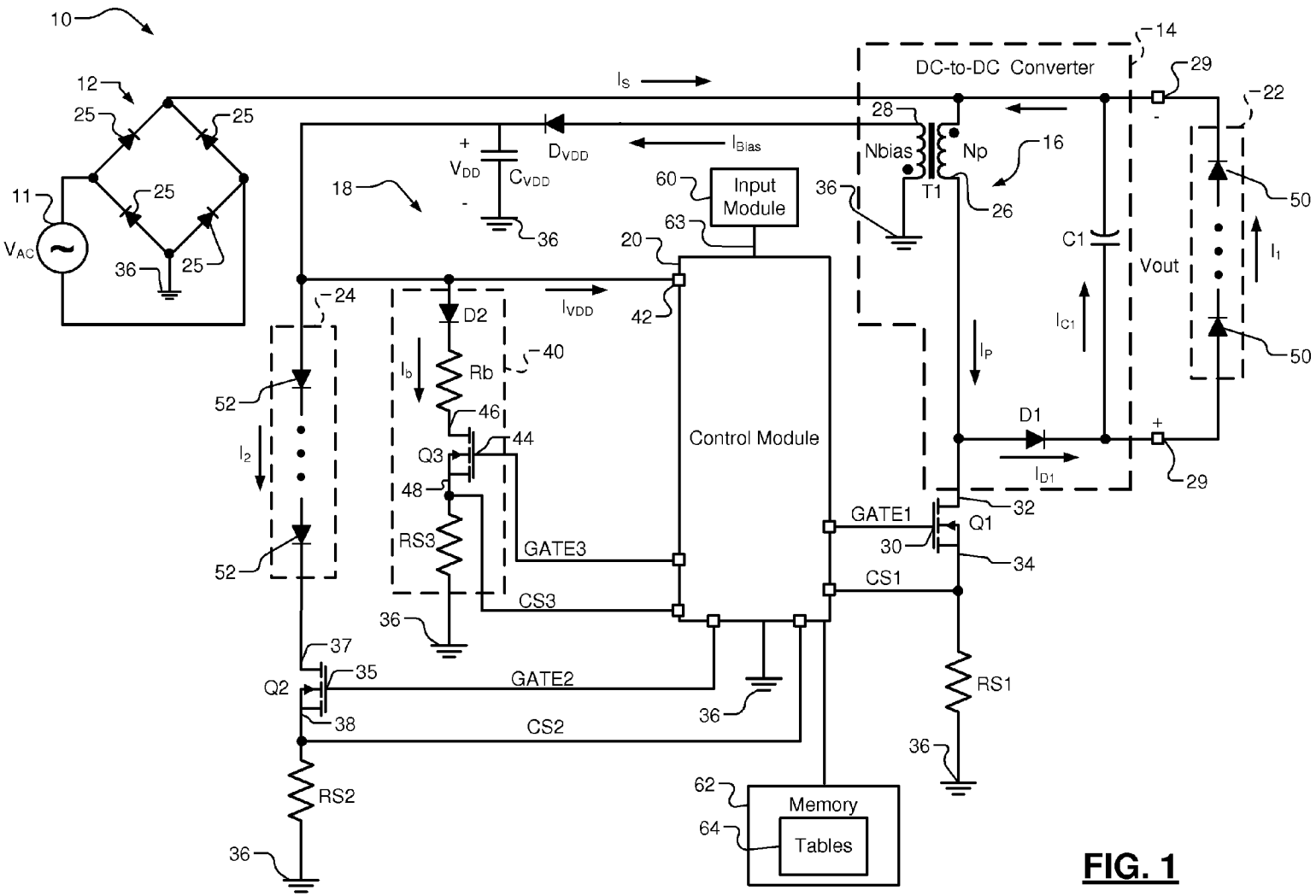
FIG. 1 is a functional block schematic diagram of a color mixing system having a buck-boost topology and incorporating solid-state load circuits with respective primary coil supplied current and bias coil supplied current in accordance with the present disclosure.

In FIG. 1, a color mixing system 10 having a buck-boost topology is shown. The color mixing system 10 includes an alternating current (AC) power source 11, a single stage converter 12, a direct current (DC)-to-DC converter 14, a first current supply circuit 16, a second current supply circuit 18, a control module 20, a first solid-state load (SSL) circuit 22, and a second SSL circuit 24. The AC power source 11 supplies AC power to the single stage converter 12. The single stage converter 12 may be implemented as a bridge rectifier circuit and includes diodes 25. The single stage converter 12 converts AC power to DC power, which is supplied to the DC-to-DC converter 14. The control module 20 controls power supplied from the DC-to-DC converter 14 to the first SSL circuit 22 and the second SSL circuit 24.

The DC-to-DC converter 14 includes an inductor or transformer T1, a first diode D1 and a capacitance C1. The inductor or transformer T1 includes a primary coil 26 and a bias coil 28. The primary coil 26 has Np windings and the bias coil 28 has Nbias windings. The primary coil 26 is connected to and receives source current $I_S$ from the single stage converter 12. The primary coil 26 is also connected in parallel with and supplies a first load current $I_1$ to the first SSL circuit 22. The first load current $I_1$ and/or output current of the first SSL circuit 22 and the capacitance current $I_{C1}$ are provided to the primary coil 26 and summed with the source current $I_S$ to provide primary coil current $I_p$ in the primary coil 26.

The first diode D1 is connected between and in series with the primary coil 26 and the first SSL circuit 22. The first diode D1 directs the primary coil current $I_p$ out of the primary coil 26 through the first SSL circuit 22 and the capacitance C1 and prevents reverse current through the primary coil 26. Current passing through the first diode D1 is designated $I_D$ and is divided to provide the first load current $I_1$ and a capacitance current $I_{C1}$. The first diode current $I_{D1}$ may be equal to the primary coil current $I_p$ based on a state of the first current supply circuit 16, as further described below. The capacitance C1 is connected in parallel with the primary coil 26 and the first SSL circuit 22 and aids in maintaining a first DC voltage across the first SSL circuit 22. The first SSL circuit 22 is connected to voltage output terminals 29, which are connected to terminals of the capacitance C1.

The first current supply circuit 16 includes the primary coil 26, a first switch Q1, and a first resistance RS1. The primary coil 26, the first switch Q1 and the first resistance RS1 are connected in series with each other. The first switch Q1 may be a metal-oxide-semiconductor field-effect transistor (MOSFET) and is controlled by the control module 20. The first switch Q1 includes a gate 30, a drain 32 and a source 34. The gate 30 is connected to the control module 20 and receives a first control signal GATE1 from the control module 20. The drain 32 is connected to the primary coil 26 and the first diode D1. The source 34 is connected to the first resistance RS1. The first resistance RS1 is connected between the source 34 and a reference terminal 36 (e.g., a ground reference terminal).

In operation, the control module 20 controls whether the primary coil current $I_p$ is provided to the first switch Q1 or the first diode D1 based on a voltage across the first resistance RS1. The voltage across the resistance RS1 is indicated by a first voltage signal CS1 provided to the control module 20. The primary coil current $I_p$ is provided to the first diode D1 when the first switch Q1 is OFF. The primary coil current $I_p$ is primarily provided to the first resistance RS1 and then to the reference terminal 36 when the first switch Q1 is ON. For this reason, the primary coil current $I_p$ is either (i) provided to the first diode D1, the capacitance C1, and the first SSL circuit 22, or (ii) passed to the reference terminal 36.

Voltage across the first SSL circuit 22 is output voltage Vout. The voltage across the first current supply circuit 16 and/or from the single stage converter 12 is identified as $V_1$. Voltage $V_{DD}$ across the second current supply circuit 18 is supplied to the power supply input 42. The relationship between the voltages $V_1$, $V_{out}$, $V_{DD}$ is determined by $N_p$, $N_{bias}$ and the duty cycle of the switch Q1.

The control module 20 monitors the voltage across the first resistance RS1 and generates the first control signal GATE1 to change the state of the first switch Q1 based on at least the voltage across the first resistance RS1. The first control signal GATE1 may be a pulse width modulated (PWM) signal having a frequency and a duty cycle. The control module 20 may adjust the frequency and/or the duty cycle to adjust the first load current $I_1$ supplied to the first SSL circuit 22 and as a result the current supplied from the primary coil 26 to the bias coil 28.

The second current supply circuit 18 includes the bias coil 28, the diode $D_{VDD}$, the capacitor $C_{VDD}$, the second SSL circuit 24, and a bleeder circuit 40. The bias coil 28 receives bias current $I_{Bias}$ from the primary coil 26. The bias current $I_{Bias}$ is distributed to primarily provide a second load current $I_2$ and a bleed current $I_b$. The second load current $I_2$ and the bleed current $I_b$ are received respectively by the second SSL circuit 24 and the bleeder circuit 40. An extra portion of the bias current $I_{Bias}$ is also provided to the control module 20 to power the control module 20. The current supplied to the control module 20 is negligible compared to the second load current $I_2$ and the bleed current $I_b$. For this reason, a sum of the second load current $I_2$ and the bleed current $I_b$ is approximately equal to the bias current $I_{Bias}$.

The second SSL circuit 24 is connected in series with a second switch Q2 and a second resistance RS2. The second switch Q2 includes a gate 35, a drain 37, and a source 38. The gate 35 is connected to the control module 20 and receives a second control signal GATE2 from the control module 20. The drain 37 is connected to the second SSL circuit 24. The source is connected to the second resistance RS2. The second SSL circuit 24, the second switch Q2, and the second resistance RS2 are connected (i) between the bias coil 28 through diode $D_{VDD}$ and the reference terminal 36, and (ii) between a power supply input 42 of the control module 20 and the reference terminal 36.

The control module 20 may be powered based on current received from the bias coil 28 via the power supply input 42. Voltage at the voltage supply input is $V_{DD}$. The control module 20 controls the second load current $I_2$ based on at least a state of the second switch Q2. The control module 20 may monitor a voltage across the second resistance RS2 as indicated by a second voltage signal CS2. The control module 20 generates the second control signal GATE2 to change state of the second switch Q2 based on at least the voltage across the second resistance RS2. The second control signal GATE2 may be a PWM signal having a frequency and a duty cycle. The control module 20 may adjust the frequency and/or the duty cycle of the second control signal GATE2 to adjust the current supplied to the second SSL circuit 24 and as a result the first load current $I_1$ supplied to the first SSL circuit 22.

The bleeder circuit 40 includes a second diode D2, a bleed resistance Rb, a third switch Q3, and a third resistance RS3. The second diode D2 prevents reverse current from passing from the bleeder circuit 40 to the bias coil 28. The second diode D2, the bleed resistance Rb, the third switch Q3 and the third resistance RS3 are connected (i) in parallel with the second SSL circuit 24, the second switch Q2, and the second resistance RS2, and (ii) in series between the bias coil 28 through diode $D_{VDD}$ and the reference terminal 36. The third switch Q3 includes a gate 44, a drain 46, and a source 48. The gate 44 is connected to the control module 20 and receives a third control signal GATE3 from the control module 20. The drain 46 is connected to the bleed resistance Rb. The source 48 is connected to the third resistance RS3. The bleed resistance Rb may be connected between the bias coil 28 through diode $D_{VDD}$ and the third switch Q3. The third switch Q3 may be connected between the bleed resistance Rb and the reference terminal 36.

The bleed circuit 40 diverts current away from the second SSL circuit 24. The amount of current diverted away from the second SSL circuit 24 is controlled by the control module 20. The control module 20 controls a state of the third switch Q3 based on a voltage across the third resistance RS3 as indicated by a third voltage signal CS3. The control module 20 monitors the voltage across the third resistance RS3 and generates the third control signal GATE3 to change the state of the third switch Q3. The third control signal GATE3 may be a PWM signal having a frequency and a duty cycle. The control module 20 may adjust the frequency and/or the duty cycle of the third control signal GATE3 to adjust the current supplied to the bleeder circuit 40 and as a result the load currents $I_1$, $I_2$ supplied to the SSL circuits 22, 24.

The SSL circuits 22, 24 may each include a series of solid-state lamps, such as a series of light emitting diodes (LEDs) 50 and 52, as shown. The SSL circuits 22, 24 and/or the solid-state lamps provide illuminated outputs. The illuminated outputs have respective colors and may be mixed to provide one or more additional illuminated outputs with respective colors.

The control module 20 controls the amount of current passing through each of the SSL circuits 22, 24 and the bleeder circuit 40 based on voltages across one or more of the resistances RS1, RS2, RS3 and/or levels of current passing through one or more of the resistances RS1, RS2, RS3. The control module 20 monitors voltages and/or currents of one or more of the resistances RS1, RS2, RS3 and controls states of each of the switches Q1, Q2, Q3 based on the monitored voltages and/or currents. The control module 20 may be connected to the reference potential 36.

The first SSL circuit 22 is not isolated from the AC power source 11 and the single stage converter 12, since (i) the single state converter 12 is directly connected to the first SSL circuit 22, and (ii) the AC power source 11, the single stage converter 12 and the first SSL circuit 22 are connected to the same reference terminal 36. The second SSL circuit 24 is also not isolated from the AC power source 11 and the single stage converter 12. The single stage converter 12 may be referred to as a non-isolated converter. For at least these reasons, the color mixing system 10 has a buck-boost topology.

The color mixing system 10 may further include an input module 60 and a memory 62. The input module 60 may include, for example, a touchpad, a keyboard, a control panel, a display, a variable resistance, or other suitable devices or components to provide an input signal 63. The control module 20 may control states of the switches Q1, Q2, Q3 based on the input signal 63. The input module 60 and/or the memory 62 may be integrated as part of the control module 20 or may be separate from the control module 20, as shown. The memory 62 may store, for example, tables 64 relating the input signal 63 from the input module 60 to predetermined colors, currents levels of the SSL circuits 22, 24, switch states of the switches Q1, Q2, Q3, and/or ratios of two or more of the current levels.

Figure 2:
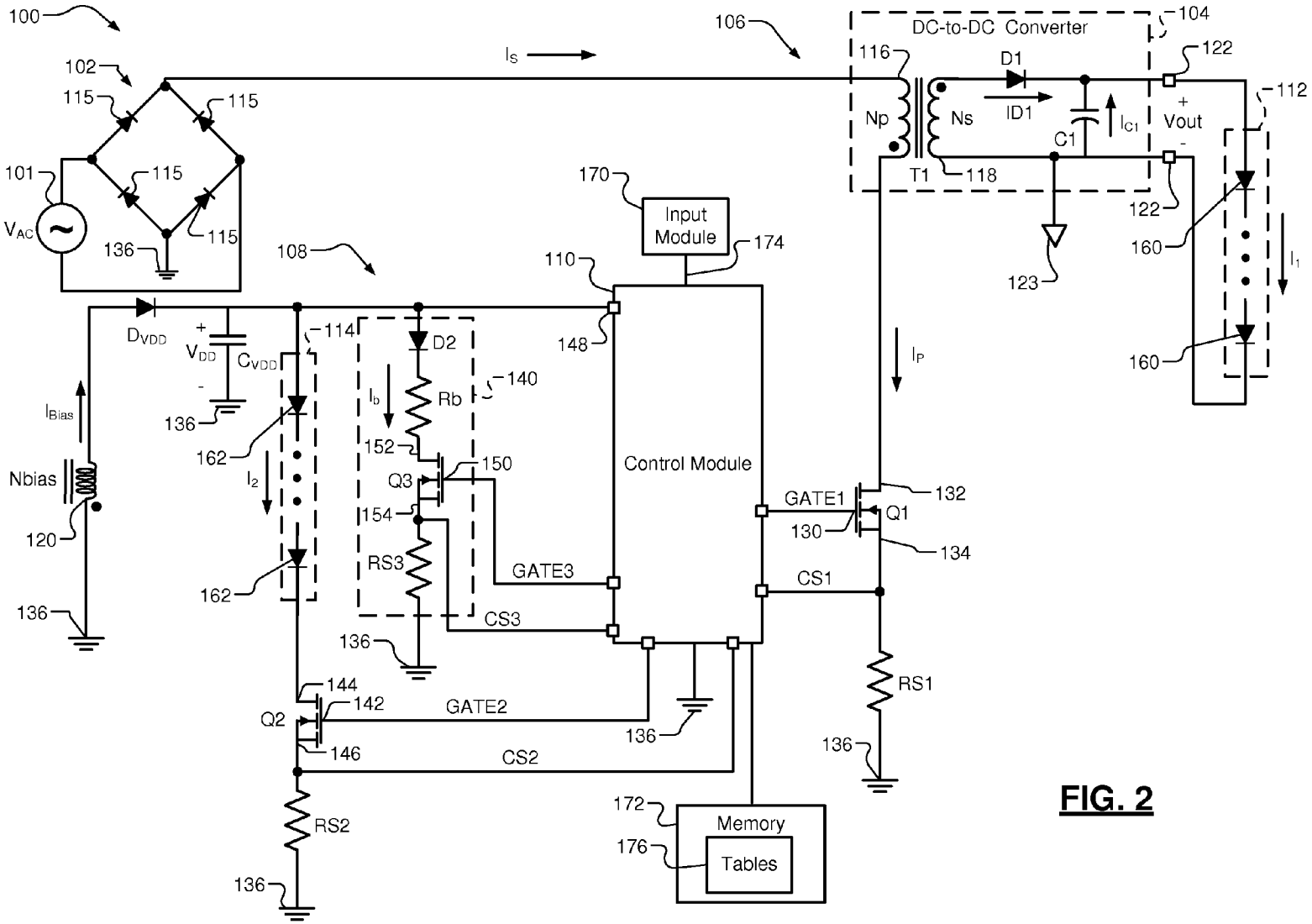
FIG. 2 is a functional block schematic diagram of a color mixing system having a flyback topology and incorporating solid-state load circuits with respective secondary coil supplied current and bias coil supplied current in accordance with the present disclosure.

In FIG. 2, a color mixing system 100 having a flyback topology is shown. The color mixing system 100 includes an AC power source 101, a single stage converter 102, a DC-to-DC converter 104, a first current supply circuit 106, a second current supply circuit 108, a control module 110, a first SSL circuit 112, and a second SSL circuit 114. The AC power source 101 supplies AC power to the single stage converter 102. The single stage converter 102 may be implemented as a bridge rectifier circuit and includes diodes 115. The single stage converter 102 converts AC power to DC power, which is supplied to the DC-to-DC converter 104. The control module 110 controls power supplied from the DC-to-DC converter 104 to the first SSL circuit 112 and the second SSL circuit 114.

The DC-to-DC converter 104 includes an inductor or transformer T1, a first diode D1 and a capacitance C1. The inductor or transformer T1 includes a primary coil 116, a secondary coil 118 and a bias coil 120. The primary coil 26 has Np windings. The secondary coil 118 has Ns windings. The bias coil 120 has Nbias windings. The primary coil 116 is connected to and receives source current $I_S$ from the single stage converter 102. The primary coil 116 supplies current to the secondary coil 118 and the bias coil 120. The secondary coil 118 is connected in parallel with and supplies a first load current $I_1$ to the first SSL circuit 112. The first load current $I_1$ and/or current out of the first SSL circuit 112 is provided from the secondary coil 118.

The first diode D1 is connected between and in series with the secondary coil 118 and the first SSL circuit 112 and prevents reverse current through the secondary coil 118. Current passing through the secondary coil 118 and the first diode D1 is designated $I_{D1}$ and is summed with a capacitance current $I_{C1}$ to provide the first load current $I_1$. The capacitance C1 is connected in parallel with the secondary coil 118 and the first SSL circuit 112 and aids in maintaining a first DC voltage across the first SSL circuit 112. The first SSL circuit 112 is connected to voltage output terminals 122, which are connected to terminals of the capacitance C1. The secondary coil 118, the capacitance C1, and the first SSL circuit 112 may not be connected to a reference potential (referred to as floating) or may be connected to a first reference terminal 123 (or first ground reference terminal), as shown.

The first current supply circuit 106 includes the primary coil 116, a first switch Q1, and a first resistance RS1. The primary coil 116, the first switch Q1, and the first resistance RS1 are connected in series with each other. The first switch Q1 may be a MOSFET and is controlled by the control module 110. The first switch Q1 includes a gate 130, a drain 132 and a source 134. The gate 130 is connected to the control module 110 and receives a first control signal GATE1 from the control module 110. The drain 132 is connected to the primary coil 116. The source 134 is connected to the first resistance RS1. The first resistance RS1 is connected between the source 134 and a second reference terminal 136 (e.g., a second ground reference terminal). The second reference terminal 136 may be at a different reference potential than the first reference terminal 123.

In operation, the control module 110 controls a current level of the primary coil current $I_p$ passing through the primary coil 116, the first switch Q1 and the first resistance RS1 based on at least a voltage across the first resistance RS1. The voltage may be indicated via a first voltage signal CS1 that is provided to the control module 110. The control module 110 monitors the voltage across the first resistance RS1 and generates the first control signal GATE1 to change the state of the first switch Q1. The first control signal GATE1 may be a pulse width modulated (PWM) signal having a frequency and a duty cycle. The control module 110 may adjust the frequency and/or the duty cycle to adjust the primary coil current $I_p$ supplied from the primary coil 116 to the secondary coil 118 and as a result the current supplied to the first SSL circuit 112. The frequency and duty cycle of the primary coil current $I_p$ may also be adjusted to adjust an amount of current supplied from the primary coil 116 to the bias coil 120.

The voltage across the first current supply circuit 106 and/or from the single stage converter 102 is identified in equation 2 as $V_1$. Voltage across the first SSL circuit 112 is output voltage Vout. Voltage across the second current supply circuit 108 is identified as $V_{DD}$ in equation 3 and is supplied to the power supply input 148. The relationship between the voltages $V_1$, Vout, $V_{DD}$ is determined by $N_p$, $N_s$, $N_{bias}$ and the duty cycle of the switch Q1.

The second current supply circuit 108 includes the bias coil 120, the diode $D_{VDD}$, the capacitor $C_{VDD}$, the second SSL circuit 114, and a bleeder circuit 140. The bias coil 120 receives bias current $I_{Bias}$ from the primary coil 116. The bias current $I_{Bias}$ is distributed to primarily provide a second load current $I_2$ and a bleed current $I_b$. The second load current $I_2$ and the bleed current $I_b$ are received respectively by the second SSL circuit 114 and the bleeder circuit 140. An extra portion of the bias current $I_{Bias}$ is also provided to the control module 110 to power the control module 110. The current supplied to the control module 110 is negligible compared to the second load current $I_2$ and the bleed current $I_b$. For this reason, a sum of the second load current $I_2$ and the bleed current $I_b$ is approximately equal to the bias current $I_{Bias}$.

The second SSL circuit 114 is connected in series with a second switch Q2 and a second resistance RS2. The second switch Q2 includes a gate 142, a drain 144, and a source 146. The gate 142 is connected to the control module 110 and receives a second control signal GATE2 from the control module 110. The drain 144 is connected to the second SSL circuit 114. The source 146 is connected to the second resistance RS2. The second SSL circuit 114, the second switch Q2, and the second resistance RS2 are connected (i) between the bias coil 120 and the reference terminal 136, and (ii) between a power supply input 148 of the control module 110 and the reference terminal 136. The control module 110 may be powered based on current received from the bias coil 120.

The control module 110 controls the second load current $I_2$ based on at least a state of a second switch Q2. The control module 110 may monitor a voltage across the second resistance RS2 as indicated by a second voltage signal CS2. The control module 110 generates the second control signal GATE2 to change state of the second switch Q2 based on at least the voltage across the second resistance RS2. The second control signal GATE2 may be a PWM signal having a frequency and a duty cycle. The control module 110 may adjust the frequency and/or the duty cycle of the second control signal GATE2 to adjust the current supplied to the second SSL circuit 114 and as a result the first load current $I_1$ supplied to the first SSL circuit 112.

The bleeder circuit 140 includes a second diode D2, a bleed resistance Rb, a third switch Q3, and a third resistance RS3. The second diode D2 prevents reverse current passing from the bleeder circuit 140 to the bias coil 120. The second diode D2, the bleed resistance Rb, the third switch Q3 and the third resistance RS3 are connected in series between the bias coil 120 and the reference terminal 136. The third switch Q3 includes a gate 150, a drain 152, and a source 154. The gate 150 is connected to the control module 110 and receives a control signal GATE3 from the control module 110. The drain 152 is connected to the bleed resistance Rb. The source 154 is connected to the third resistance RS3. The bleed resistance Rb may be connected between the bias coil 120 and the third switch Q3. The third switch Q3 may be connected between the bleed resistance Rb and the reference terminal 136.

The bleeder circuit 140 diverts current away from the second SSL circuit 114. The amount of current diverted away from the second SSL circuit 114 is controlled by the control module 110. The control module 110 monitors the voltage across the third resistance RS3 and generates the third control signal GATE3 to change the state of the third switch Q3. The third control signal GATE3 may be a PWM signal having a frequency and a duty cycle. The control module 110 may adjust the frequency and/or the duty cycle of the third control signal GATE3 to adjust the current supplied to the bleeder circuit 140 and as a result the load currents $I_1$, $I_2$ supplied to the SSL circuits 112, 114.

The SSL circuits 112, 114 may each include a series of solid-state lamps, such as a series of LEDs 160, 162, as shown. The SSL circuits 112, 114 and/or the solid-state lamps provide illuminated outputs. The illuminated outputs have respective colors and may be mixed to provide one or more additional illuminated outputs with respective colors.

The control module 110 controls the amount of current passing through each of the SSL circuits 112, 114 and the bleeder circuit 140 based on voltages across one or more of the resistances RS1, RS2, RS3 and/or levels of current passing through one or more of the resistances RS1, RS2, RS3. The control module 110 monitors voltages and/or currents of one or more of the resistances RS1, RS2, RS3 and controls states of each of the switches Q1, Q2, Q3 based on the monitored voltages and/or currents. The control module 110 may be connected to the reference terminal 136.

The first SSL circuit 112 is isolated from the AC power source 101 and the single stage converter 102. The isolation is provided via the inductor or transformer T1 and by the connection of the first SSL circuit 112 to a different reference terminal than the AC power source 101 and the single stage converter 102. The second SSL circuit 114 is not isolated from the AC power source 101 and the single stage converter 102. Although some isolation is provided between the single stage converter 102 and the second SSL circuit 114 via the inductor or transformer T1, the second SSL circuit 114 is connected to the same reference terminal 136 as the AC power source 101 and the single stage converter 102. The single stage converter 102 may be referred to as an isolated converter. For at least these reasons, the color mixing system 100 has a flyback topology.

The color mixing system 100 may further include an input module 170 and a memory 172. The input module 170 may include, for example, a touchpad, a keyboard, a control panel, a display, a variable resistance, or other suitable devices or components to provide an input signal 174. The control module 110 may control states of the switches Q1, Q2, Q3 based on the input signal 174. The input module 170 and/or the memory 172 may be integrated as part of the control module 110 or may be separate from the control module 110, as shown. The memory 172 may store, for example, tables 176 relating the input signal from the input module 170 to predetermined colors, currents levels of the SSL circuits 112, 114, switch states of the switches Q1, Q2, Q3, and/or ratios of two or more of the current levels.

Figure 3:
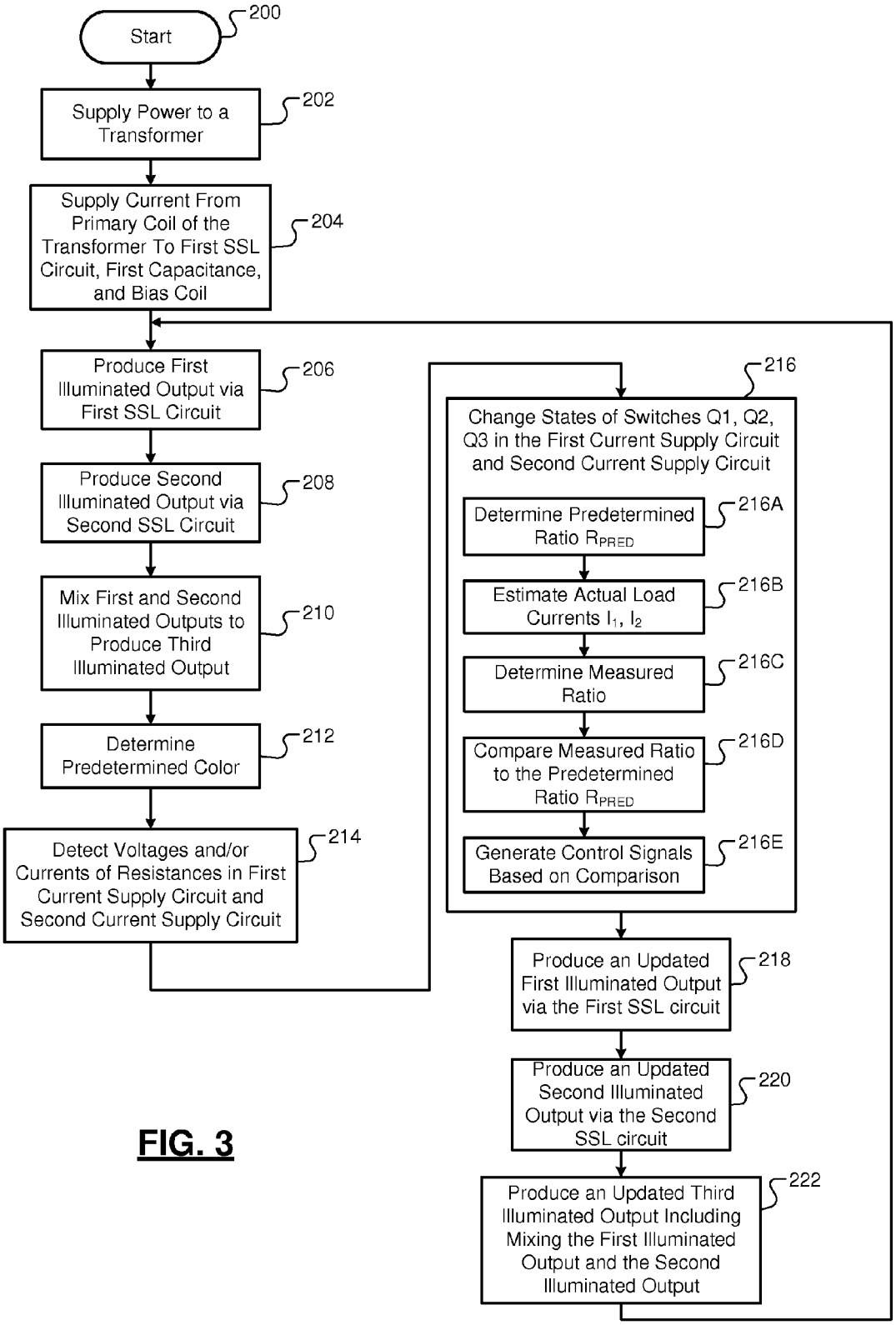
FIG. 3 illustrates a method of performing color mixing using the color mixing system of FIG. 1.
Figure 4:
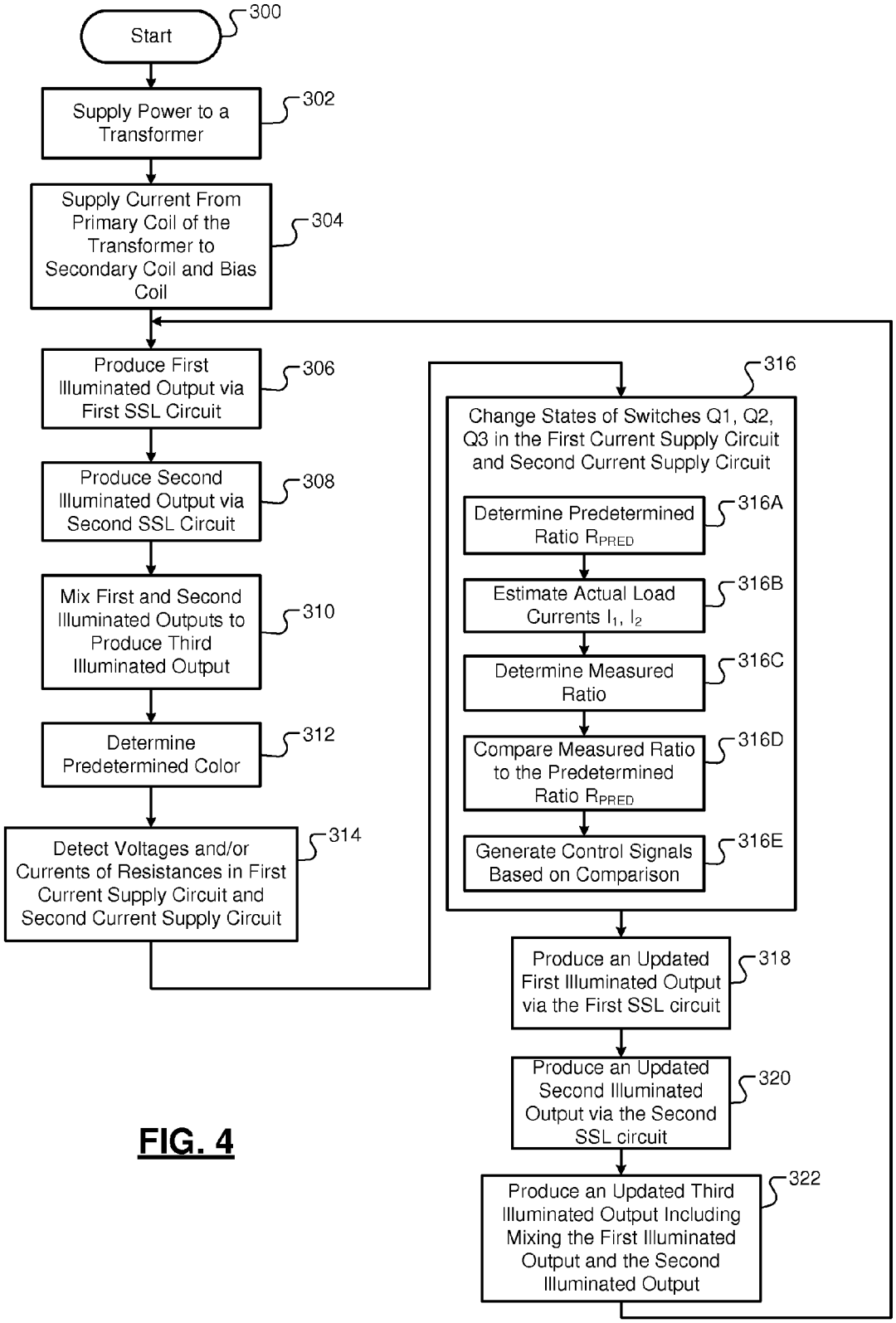
FIG. 4 illustrates another method of performing color mixing using the color mixing system of FIG. 2.

The color mixing systems disclosed herein (e.g., color mixing systems 10, 100) may be operated using numerous methods, example methods are illustrated in FIGS. 3-4. In FIG. 3, a method of performing color mixing using the color mixing system 10 of FIG. 1 is shown. Although the following tasks are primarily described with respect to the implementations of FIG. 1, the tasks may be easily modified to apply to other implementations of the present disclosure. The tasks may be iteratively performed. The method of FIG. 3 may begin at 200.

At 202, power out of the AC power source 11 is turned ON and the primary coil 26 receives the source current $I_S$ from the single stage converter 12 or other suitable power source. At 204, the inductor or transformer T1 supplies current from the primary coil 26 to the first SSL circuit 22, the capacitance C1, and to the bias coil 28, as described above. The inductor or transformer T1, having coils 26, 28, converts a first DC voltage across the primary coil 26 to a second DC voltage across the bias coil 28.

At 206, the first SSL circuit 22 produces a first illuminated output having a first color based on the currents $I_p$, $I_{D1}$, $I_1$, $I_{Bias}$, $I_2$, $I_b$. At 208, the second SSL circuit 24 produces a second illuminated output having a second color based on currents $I_p$, $I_1$, $I_{Bias}$, $I_2$, $I_b$. The second color may be different than the first color. At 210, the second illuminated output is mixed with the first illuminated output to produce a third or resulting illuminated output having a third color. The third color may be different than the first color and/or the second color. This may include directing the second illuminated output over the first illuminated output and/or overlapping the second illuminated output with the first illuminated output.

At 212, the input module 60 generates an input signal 63 and/or the control module 20 determines a predetermined color. The input signal 63 may be received and/or generated by the control module 20. The input signal 63 may be, for example, a voltage that indicates a predetermined color. The input signal 63 may change or may be a fixed value and/or voltage. At 214, the control module 20 detects voltages across one or more of the resistances RS1, RS2, RS3 and/or current through one or more of the resistances RS1, RS2, RS3.

At 216, the control module 20 changes states of one or more of the switches Q1, Q2, Q3, frequencies of one or more of the control signals GATE1, GATE2, GATE3, and/or duty cycles of one or more of the control signals GATE1, GATE2, GATE3 based on the voltages across one or more of the resistances RS1, RS2, RS3 and/or current through one or more of the resistances RS1, RS2, RS3. The states, frequencies and/or duty cycles may be changed to provide a resulting illuminated output having the predetermined color. The states, frequencies and/or duty cycles of each of the switches Q1, Q2, Q3 may be changed based on the input signal 63 and/or the predetermined color. The states of each of the switches Q1, Q2, Q3 may be, for example, OPEN (or OFF) and CLOSED (or ON). The states, frequencies and/or duty cycles of the switches Q1, Q2, Q3 are changed to alter current passing through and/or power provided to the first SSL circuit 22, the second SSL circuit 24, and the bleeder circuit 40. The control module 20 may control the states, frequencies and/or duty cycles of the switches Q1, Q2, Q3 to satisfy equations 4-6, where $R_{PRED}$ is a predetermined current ratio between the first load current $I_1$ and the second load current $I_2$.

At 216A, the control module 20 may determine the predetermined current ratio $R_{PRED}$ based on the input signal 63 and/or predetermined color. The predetermined current ratio $R_{PRED}$ may be determined based on a table (e.g., one of the tables 64) relating ratio values to various colors and/or corresponding input voltages of the input signal 63. The table may be stored in the memory 62 and accessed by the control module 20.

$$I_p = I_1 + I_2 + I_b \tag{4}$$

$$I_1 = I_p - I_2 - I_b \tag{5}$$

$$R_{PRED} = \frac{I_1}{I_2} \tag{6}$$

The currents $I_p$, $I_1$, $I_2$, $I_b$ may be referred to as normalized averaged currents. The currents $I_p$, $I_1$, $I_2$, $I_b$ may be referred to as normalized currents because the currents are the primary currents of concern and the equations 4, 5 are provided without including other negligible currents. For example, current supplied to the control module 20 via the power supply input 42 is not incorporated in equations 4, 5, as the current supplied to the control module 20 may be substantially less than the second load current $I_2$ and the bleed current $I_b$. The currents $I_p$, $I_1$, $I_2$, $I_b$ may be average currents determined over a predetermined time period.

At 216B, the control module 20 may determine and/or estimate actual load currents $I_1$, $I_2$ of the SSL circuits 22, 24 based on the voltages across the resistances RS1, RS2, RS3. At 216C, the control module 20 may then determine a measured ratio based on the load currents $I_1$, $I_2$. The measured ratio is equal to the first load current $I_1$ divided by the second load current $I_2$. At 216D, the control module 20 compares the measured ratio to the predetermined ratio $R_{PRED}$ and determines a difference between the measured ratio and the predetermined ratio $R_{PRED}$. At 216E, the control module 20 may then generate and/or adjust one or more of the control signals CS1, CS2, CS3 based on the difference between the measured ratio and the predetermined ratio $R_{PRED}$.

At 218, the first SSL circuit 22 produces an updated first illuminated output having an updated first color based on the control signals CS1, CS2, CS3 and resulting currents $I_p$, $I_{D1}$, $I_1$, $I_{Bias}$, $I_2$, $I_b$. At 220, the second SSL circuit 24 produces an updated second illuminated output having an updated second color based on the control signals CS1, CS2, CS3 and resulting currents $I_p$, $I_{D1}$, $I_1$, $I_{Bias}$, $I_2$, $I_b$. The updated second color provided at 220 may be different than the first color provided at 218.

At 222, the illuminated outputs produced at 218, 220 are mixed to produce an updated third or resulting illuminated output having an updated third color. The updated third color provided at 222 may be different than the updated first and second colors provided at 218, 220 and may be the same as the predetermined color determined at 212. Task 212 may be performed subsequent to task 222.

In FIG. 4, a method of performing color mixing using the color mixing system 100 of FIG. 2 is shown. Although the following tasks are primarily described with respect to the implementations of FIG. 2, the tasks may be easily modified to apply to other implementations of the present disclosure. The tasks may be iteratively performed. The method of FIG. 4 may begin at 300.

At 302, power out of the AC power source 101 is turned ON and the primary coil 116 receives the source current $I_s$ from the single stage converter 102 or other suitable power source. At 304, the inductor or transformer T1 supplies current from the primary coil 116 to the secondary coil 118 and the bias coil 120. The inductor or transformer T1 having, coils 116, 118, 120, converts a first DC voltage to (i) a second DC voltage across the secondary coil 118, and (ii) a third DC voltage across the bias coil 120.

At 306, the first SSL circuit 112 produces a first illuminated output having a first color based on the currents $I_p$, $I_{D1}$, $I_1$, $I_{Bias}$, $I_2$, $I_b$. At 308, the second SSL circuit 114 produces a second illuminated output having a second color based on currents $I_p$, $I_{D1}$, $I_1$, $I_{Bias}$, $I_2$, $I_b$. The second color may be different than the first color. At 310, the second illuminated output is mixed with the first illuminated output to produce a third or resulting illuminated output having a third color. The third color may be different than the first color and/or the second color. This may include directing the second illuminated output over the first illuminated output and/or overlapping the second illuminated output with the first illuminated output.

At 312, the input module 170 generates an input signal 174 and/or the control module 110 determines a predetermined color. The input signal 174 may be received and/or generated by the control module 110. The input signal 174 may be, for example, a voltage that indicates a predetermined color. The input signal 174 may change or may be a fixed value and/or voltage. At 314, the control module 110 detects voltages across one or more of the resistances RS1, RS2, RS3 and/or current through one or more of the resistances RS1, RS2, RS3.

At 316, the control module 110 changes states of one or more of the switches Q1, Q2, Q3, frequencies of one or more of the control signals GATE1, GATE2, GATE3, and/or duty cycles of one or more of the control signals GATE1, GATE2, GATE3 based on the voltages across one or more of the resistances RS1, RS2, RS3 and/or current through one or more of the resistances RS1, RS2, RS3. The states, frequencies and/or duty cycles may be changed to provide a resulting illuminated output having the predetermined color. The states, frequencies and/or duty cycles of each of the switches Q1, Q2, Q3 may be changed based on the input signal 63 and/or the predetermined color. The states of each of the switches Q1, Q2, Q3 may be, for example, OPEN (or OFF) and CLOSED (or ON). The states, frequencies and/or duty cycles of the switches Q1, Q2, Q3 are changed to alter current passing through and/or power provided to the first SSL circuit 112, the second SSL circuit 114, and the bleed circuit 140. The control module 110 may control the states, frequencies and/or duty cycles of the switches Q1, Q2, Q3 to satisfy equations 4-6.

At 316A, the control module 110 may determine the predetermined current ratio $R_{PRED}$ based on the input signal 174 and/or predetermined color. The predetermined current ratio $R_{PRED}$ may be determined based on a table (e.g., one of the tables 176) relating ratio values to various colors and/or corresponding input voltages of the input signal 174. The table may be stored in the memory 172 and accessed by the control module 110.

At 316B, the control module 110 may determine and/or estimate actual the load currents $I_1$, $I_2$ of the SSL circuits 112, 114 based on the voltages across the resistances RS1, RS2, RS3. At 316C, the control module 110 may then determine a measured ratio based on the load currents $I_1$, $I_2$. The measured ratio is equal to the first load current $I_1$ divided by the second load current $I_2$. At 316D, the control module 110 compares the measured ratio to the predetermined ratio $R_{PRED}$ and determines a difference between the measured ratio and the predetermined ratio $R_{PRED}$. At 316E, the control module 110 may then generate and/or adjust one or more of the control signals CS1, CS2, CS3 based on the difference between the measured ratio and the predetermined ratio $R_{PRED}$.

At 318, the first SSL circuit 112 produces an updated first illuminated output having an updated first color based on the control signals CS1, CS2, CS3 and resulting currents $I_p$, $I_{D1}$, $I_1$, $I_{Bias}$, $I_2$, $I_b$. At 320, the second SSL circuit 114 produces an updated second illuminated output having an updated second color based on the control signals CS1, CS2, CS3 and resulting currents $I_p$, $I_{D1}$, $I_1$, $I_{Bias}$, $I_2$, $I_b$. The updated second color provided at 320 may be different than the updated first color provided at 318.

At 322, the illuminated outputs produced at 318, 320 are mixed to produce an updated third or resulting illuminated output having an updated third color. The updated third color provided at 322 may be different than the updated first and second colors provided at 318, 320 and may be the same as the predetermined color determined at 312. Task 312 may be performed subsequent to task 322.

The above-described tasks of FIGS. 3-4 are meant to be illustrative examples; the tasks may be performed sequentially, synchronously, simultaneously, continuously, during overlapping time periods or in a different order depending upon the application. Also, any of the tasks may not be performed or skipped depending on the implementation and/or sequence of events.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

What is claimed is:

1. A system comprising:

a first lamp configured to, generate a first output of light based on a first amount of current supplied to the first lamp, wherein the first output of light has a first color;

a second lamp configured to generate a second output of light based on a second amount of current supplied to the second lamp, wherein the second output of light has a second color, wherein the first output of light is mixed with the second output of light to provide a mixture of light, and wherein the mixture of light has a third color;

one of an inductor or a transformer comprising a first coil and a second coil, wherein the first coil is configured to supply power to the first lamp, and wherein the second coil is configured to supply power to the second lamp;

a first switch connected to the first coil;

a second switch connected to the second coil; and a control module configured to alter the third color of the mixture of light by controlling (i) a state of the first switch to adjust the first amount of current supplied to the first lamp, and (ii) a state of the second switch to adjust the second amount of current supplied to the second lamp.

2. The system of claim 1, wherein the control module is configured to change the first color of the first output of light by changing the state of the first switch to adjust a third amount of current through the first coil.

3. The system of claim 2, further comprising a resistance connected to the first switch, wherein the control module is configured to (i) detect a voltage across the resistance, and (ii) change the state of the first switch based on the voltage.

4. The system of claim 2, wherein the control module is configured to change the second color of the second output of light by changing the state of the second switch to adjust the second amount of current supplied to the second lamp.

5. The system of claim 4, further comprising a resistance connected to the second switch, wherein the control module is configured to (i) detect a voltage across the resistance, and (ii) change the state of the second switch based on the voltage.

6. The system of claim 4, wherein the control module is configured to adjust the second amount of current supplied to the second lamp by changing the state of the first switch.

7. The system of claim 4, wherein:

the first coil is configured to receive a fourth amount of current from a power source; and the third amount of current through the first coil is equal to a sum of the fourth amount of current and the first amount of current.

8. The system of claim 4, further comprising:

a third switch connected in parallel with a circuit, wherein the circuit comprises the second switch and the second lamp; and the control module is configured to control a state of the third switch to adjust the second amount of current supplied to the second lamp.

9. The system of claim 8, wherein, based on the state of the first switch, the state of the second switch, and the state of the third switch:

the first amount of current is supplied to the first lamp;

a second amount of current is supplied to the second lamp;

the third amount of current is supplied to the first coil;

a fourth amount of current passes through the third switch; and the control module is configured to control the first switch, the second switch and the third switch such that the third amount of current is equal to a sum of the first amount of current, the second amount of current and the fourth amount of current.

10. The system of claim 8, further comprising a resistance connected in series with the third switch, wherein the control module is configured to (i) detect a voltage across the resistance, and (ii) change the state of the third switch based on the voltage.

11. The system of claim 1, wherein:

the one of the inductor or the transformer comprises a third coil; and the third coil is configured to receive the first amount of current from the first coil and supply the first amount of current to the first lamp.

12. The system of claim 11, wherein:

the first switch is connected in series with the first coil; and the control module is configured to change the first color by changing the state of the first switch to adjust the first amount of current received by the third coil.

13. The system of claim 11, wherein the second coil is configured to:

receive the second amount of current from the first coil; and supply the second amount of current to the second lamp and the control module.

14. The system of claim 13, further comprising a resistance connected in series with the second switch, wherein:

the second switch is connected (i) in series with the second lamp, and (ii) in parallel with the second coil; and the control module is configured to detect a voltage across the resistance, change the state of the second switch based on the voltage, and change the second color by changing the state of the second switch to (i) adjust the second amount of current supplied to the second lamp.

15. The system of claim 1, wherein the control module is configured to:

receive an input voltage;

determine a fourth color based on a first ratio, wherein the first ratio is based on the input voltage;

estimate the first amount of current and the second amount of current;

determine a second ratio based on the first amount of current and the second amount of current;

compare the first ratio to the second ratio; and based on the comparison between the first ratio and the second ratio, change (i) the state of the first switch to update the first output of light, or (ii) the state of the second switch to update the second output of light, wherein the updating of the first output of light or the updating of the second output of light changes the third color to the fourth color.

16. A method comprising:

supplying a first amount of current to a first lamp to generate a first output of light, wherein the first output of light has a first color;

supplying a second amount of current to a second lamp to generate a second output of light, wherein the second output of light has a second color, wherein the first output of light is mixed with the second output of light to provide a mixture of light, and wherein the mixture of light has a third color;

based on a state of a first switch, supplying power to the first lamp via a first coil;

based on a state of a second switch, supplying power to the second lamp via a second coil, wherein one of an inductor or a transformer comprises the first coil and the second coil; and altering the third color of the mixture of light by controlling (i) the state of the first switch to adjust the first amount of current supplied to the first lamp, and (ii) the state of the second switch to adjust the second amount of current supplied to the second lamp.

17. The method of claim 16, further comprising:

detecting a first voltage across a first resistance, wherein the first resistance is connected to the first switch;

detecting a second voltage across a second resistance, wherein the second resistance is connected to the second switch;

based on the first voltage, changing the first color of the first output of light by changing the state of the first switch to adjust a third amount of current through the first coil; and based on the second voltage, changing the second color of the second output of light by changing the state of the second switch to adjust the second amount of current supplied to the second lamp.

18. The method of claim 17, further comprising receiving a fourth amount of current from a power source at the first coil, wherein the third amount of current through the first coil is equal to a sum of the fourth amount of current and the first amount of current.

19. The method of claim 17, further comprising:

controlling a state of a third switch to adjust the second amount of current supplied to the second lamp, wherein the third switch is connected in parallel with a circuit, and wherein the circuit comprises the second switch and the second lamp, wherein, based on the state of the first switch, the state of the second switch, and the state of the third switch the first amount of current is supplied to the first lamp, the second amount of current is supplied to the second lamp, the third amount of current is supplied to the first coil, and a fourth amount of current passes through the third switch; and controlling the first switch, the second switch and the third switch such that the third amount of current is equal to a sum of the first amount of current, the second amount of current and the fourth amount of current.

20. The method of claim 16, further comprising:

receiving an input voltage;

determining a fourth color based on a first ratio, wherein the first ratio is based on the input voltage;

estimating the first amount of current and the second amount of current;

determining a second ratio based on the first amount of current and the second amount of current;

comparing the first ratio to the second ratio; and based on the comparison between the first ratio and the second ratio, changing (i) the state of the first switch to update the first output of light, or (ii) the state of the second switch to update the second output of light, wherein the updating of the first output of light or the updating of the second output of light changes the third color to the fourth color.

* * * * *